US006735882B2

(12) United States Patent
Takahashi

(10) Patent No.: US 6,735,882 B2
(45) Date of Patent: May 18, 2004

(54) DRYING APPARATUS

(75) Inventor: Shinsuke Takahashi, Odawara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/284,305

(22) Filed: Oct. 31, 2002

(65) Prior Publication Data

US 2003/0079372 A1 May 1, 2003

(30) Foreign Application Priority Data

Oct. 31, 2001 (JP) ..... 2001-334422

(51) Int. Cl.[7] ..... F26B 25/06

(52) U.S. Cl. ..... 34/212; 34/86; 34/636; 34/224

(58) Field of Search ..... 34/86, 636, 210, 34/212, 219, 224, 235

(56) References Cited

U.S. PATENT DOCUMENTS 4,240,787 A * 12/1980 Jalmaluddin ..... 432/21
4,263,721 A * 4/1981 Danford ..... 34/514
4,270,283 A * 6/1981 Ellis ..... 34/212
4,662,840 A * 5/1987 Ellison ..... 432/8
5,105,558 A * 4/1992 Curry ..... 34/449

FOREIGN PATENT DOCUMENTS

JP 2-25074 2/1990
JP 6-28221 8/1994

* cited by examiner

*Primary Examiner*—Ira S. Lazarus
*Assistant Examiner*—Kathryn S. O'Malley
(74) *Attorney, Agent, or Firm*—Sughrue Mion, PLLC

(57) ABSTRACT

A concentration of a gas introduced into a circulation blower and an exhaust blower is reduced with a simple apparatus configuration. In an exhaust system, exhaust gases from a plurality of drying chambers are joined to a joining duct to be then exhausted by an exhaust blower. A plurality of exhaust ducts having inlets at different positions in each drying chamber are provided, and the exhaust duct having the inlet in the lowest gas concentration area is used as a duct for an exhaust gas circulated to a circulation blower.

4 Claims, 4 Drawing Sheets

DRYING APPARATUS

BACKGROUND OF THE INVENTION

1. Field of the Invention

The present invention relates to a drying apparatus and, more particularly, to a drying apparatus for an organic solvent that is used for manufacturing a photosensitive material or a magnetic recording medium.

2. Description of the Related Art

Generally, photosensitive materials and magnetic recording media are manufactured through a drying process after a predetermined coating liquid such as a magnetic liquid is applied on a continuously traveling support (hereinafter referred to as a web), so that an organic solvent in the coating liquid is evaporated by a drying apparatus to dry the coating liquid.

Such a drying apparatus for an organic solvent requires that an organic solvent concentration (hereinafter referred to as a gas concentration) of an exhaust gas containing the organic solvent is kept sufficiently lower than a lower explosive level (LEL). If the gas concentration cannot be kept lower than the lower explosive level, expensive explosion proof equipment must be provided to secure safety. Especially, in view of explosion proofing safety of the drying apparatus, a blower is a device to be an ignition source, and it is important to keep a low concentration of a gas introduced into the blower.

The drying process is generally divided into three periods: a remaining heat period, a constant rate period, and a falling rate period. In drying an organic solvent that has a relatively low boiling point and is used for a magnetic recording medium, the solvent often dries quickly, and the organic solvent rapidly evaporates from a coating liquid. Specifically, the constant rate period is extremely short to soon reach a later stage of the falling rate period. To avoid this danger, it is necessary to increase the amount of fresh air introduced into the blower, and also necessary to balance the amount of exhaust air. In this case, even if only a part of the drying apparatus is in danger in view of explosion proofing, it is necessary to balance the amount of exhaust air in the entire drying apparatus. This reduces efficiency of the drying apparatus to require a complex device that can set the amount of supplied and exhausted air for each drying zone, thus increasing the weight and the length of the drying apparatus.

Japanese Utility Model Publication No. 6-28221 discloses a gas concentration control that controls a gas concentration of a drying apparatus for an organic solvent to be kept lower than a lower explosive level includes an inner pressure/solvent gas concentration control device in a dryer.

This dryer includes a plurality of drying zones, and ducts of a supply system and an exhaust system connect to each drying zone. In the supply system, a circulation air from each drying zone by circulation piping and a fresh air by supply piping are mixed at a constant ratio to supply the mixed air to the drying zone by a circulation blower. In the exhaust system, an exhaust blower with a variable speed control motor provided in the exhaust duct joins an exhaust gas to exhaust piping. The joined gas is exhausted by a main exhaust blower, and damper opening control by a damper with an opening control motor provided in the exhaust system is automatically adjusted based on measurements of a gas concentration meter placed midway through the exhaust duct, thus a solvent gas concentration of the exhaust gas is controlled to be lower than the lower explosive level.

However, in the conventional drying apparatus in Japanese Utility Model Publication No. 6-28221, when the organic solvent rapidly evaporates in one of the plurality of drying zones, an exhaust gas with an extremely high gas concentration is circulated to the circulation blower, which may cause a dangerous operating condition in view of explosion proofing without a large amount of fresh air mixed by a main supply blower. As a result, a main supply blower and a circulation blower having a large capacity must be provided to increase equipment costs and running costs. The method in which the damper opening control by the damper with the opening control motor is automatically adjusted based on the measurements of the gas concentration meter placed midway through the exhaust duct to keep the gas concentration of the exhaust gas to be lower than the lower explosive level increases the size of the explosion proof system, apparatus costs and running costs.

SUMMARY OF THE INVENTION

The present invention has been achieved in view of the above and has an object to provide a drying apparatus that has a simple apparatus configuration and reduces a concentration of a gas introduced into a circulation blower and an exhaust blower to simplify an explosion proof system and significantly reduce equipment costs and running costs.

To achieve the above-mentioned object, the present invention is directed to a drying apparatus, comprising: a plurality of drying chambers arranged in line through which a web with a coating film applied thereon travels to dry the coating film; a supply system having in each drying chamber a circulation blower which supplies a dry air that is a mixture of a fresh air and part of exhaust gases circulated from the drying chambers; and an exhaust system which exhausts the exhaust gas from each of the plurality of drying chambers, wherein the exhaust system comprises: a joining duct to which the exhaust gases from the plurality of drying chambers are joined; an exhaust blower provided in the joining duct; and a plurality of exhaust ducts provided in each drying chamber and having inlets at different positions in the drying chamber, wherein the plurality of exhaust ducts form an independent exhaust passage comprising a duct for circulating the exhaust gas to the circulation blower, and a duct for directly feeding the exhaust gas to the joining duct.

According to the present invention, in the exhaust system, the exhaust gases from the plurality of drying chambers are joined to the joining duct to be then exhausted by the exhaust blower, thus the gases having high or low concentrations depending on the drying chambers are joined to the joining duct to dilute the exhaust gas from the drying chamber having the high gas concentration with the exhaust gas from the drying chamber having the low gas concentration. The diluted exhaust gas is introduced into the exhaust blower, thereby allowing a gas concentration in the exhaust blower to be an ignition source in view of explosion proofing safety to be kept lower than a lower explosive level with a simple apparatus configuration.

The plurality of exhaust ducts having the inlets at the different positions in the drying chamber are provided to form the independent exhaust passage comprising the duct for circulating the exhaust gas to the circulation blower, and the duct for directly feeding the exhaust gas to the joining duct. This configuration allows the exhaust duct having the inlet in the lowest gas concentration area to be used as a duct for the exhaust gas circulated to the circulation blower, and allows the exhaust duct having the inlet in a high gas concentration area to be used as a duct for the exhaust gas directly fed to the joining duct. This prevents the exhaust gas with the high gas concentration from being introduced into the circulation blower. Therefore, the gas concentration in the circulation blower to be an ignition source in view of explosion proofing safety can be kept lower than the lower explosive level with a simple apparatus configuration.

It is preferable to provide a switching device for optionally switching communication targets of the plurality of exhaust ducts between the circulation blower and the joining duct. In this case, it is more preferable to provide a gas concentration meter in the plurality of exhaust ducts so that the exhaust duct having the inlet in the lowest gas concentration area communicates with the circulation blower based on measurement results.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Embodiments of a drying apparatus according to the present invention will be described below with reference to the accompanying drawings.

Figure 1:
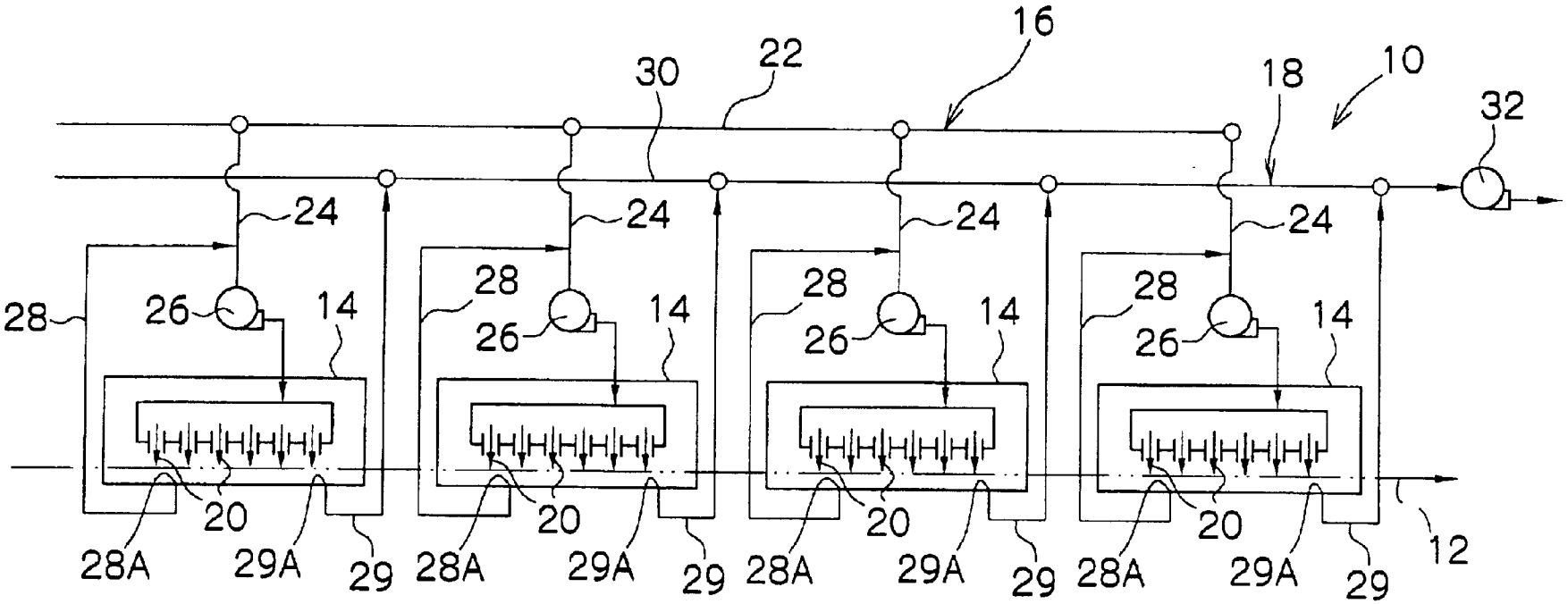
FIG. 1 illustrates a concept of a drying apparatus according to a first embodiment of the present invention.

FIG. 1 illustrates a concept of a drying apparatus according to a first embodiment of the present invention. In FIG. 1, drying chambers are separately provided but may be provided adjacent to each other.

As shown in FIG. 1, a drying apparatus 10 of the first embodiment includes four drying chambers 14 arranged in line along a traveling direction of a web 12 with a coating liquid applied thereon, a supply system 16 that supplies a dry air to each drying chamber 14, and an exhaust system 18 that exhausts from the drying chamber 14 an exhaust gas containing an organic solvent evaporated from the coating liquid. The number of the drying chambers 14 is not limited to four, but may be at least two.

In the drying chamber 14, many nozzles 20 are arranged along the traveling direction of the web 12, and the dry air from the supply system 16 is blown on the web 12 via the nozzles 20. This causes the organic solvent in the coating liquid applied on the web 12 to evaporate and dry. In FIG. 1, the nozzles 20 are placed above the web 12, but not limited to this, may be provided both above and below the web 12. The web 12 may be conveyed and supported in the drying chamber 14 by support rollers (not shown) arranged in the drying chamber 14, or may be supported by air from above and below the web 12 without contact.

The supply system 16 includes an outside air introducing duct 22 that introduces a fresh air, a supply duct 24 that branches off the outside air introducing duct 22 and reaches each drying chamber 14, and a circulation blower 26 provided in the supply duct 24, and an exhaust duct 28 for circulation mentioned below connects to an inlet side of the circulation blower 26. This causes a dry air that is a mixture of part of the exhaust gas from the drying chamber 14 and a fresh air from the outside air introducing duct 22 to be supplied to the drying chamber 14.

The exhaust system 18 includes a joining duct 30 to which the exhaust gases from the drying chambers 14 join, an exhaust blower 32 provided in the joining duct 30, and two exhaust ducts 28, 29 having inlets 28A, 29A at different positions in the drying chamber 14. Among the two exhaust ducts 28, 29, the exhaust duct 28 having the inlet 28A in a low gas concentration area connects to the supply duct 24 that is on the inlet side of the circulation blower 26, and the exhaust duct 29 having the inlet 29A in a high gas concentration area directly connects to the joining duct 30. Thus, the two exhaust ducts 28, 29 form an independent exhaust passage comprising a duct for circulating the exhaust gas to the circulation blower 26, and a duct for directly feeding the exhaust gas to the joining duct 30. In this case, gas concentration distribution in the drying chamber 14 may be previously measured to select which of the exhaust ducts 28, 29 connects to the circulation blower 26. The number of the exhaust duct 28, 29 is not limited to two, but may be at least two. In FIG. 1, the inlets 28A, 29A of the exhaust ducts 28, 29 are placed at an upstream position and a downstream position of the web traveling direction, but not limited to this, they are preferably placed at a plurality of positions in the high and low gas concentration areas based on the gas concentration distribution in each drying chamber 14. The exhaust duct 28 having the inlet 28A at the upstream position connects to the circulation blower 26 side in all the drying chambers 14, but not limited to this, it is necessary to connect the exhaust duct 28 or 29 having the inlet in the low gas concentration area to the circulation blower 26 in each drying chamber 14.

Next, operations of the supply system 16 and the exhaust system 18 of the drying apparatus 10 configured as the above will be described. The description will be made with reference to an example in FIG. 1 in which the gas concentration in the drying chamber 14 is low on the upstream side and high on the downstream side of the web traveling direction.

Reduction in the gas concentration of the exhaust gas introduced into the exhaust blower 32 provided in the exhaust system 18 is solved by joining the exhaust gases from the plurality of drying chambers 14 to the joining duct 30 and then exhausting the gas by the exhaust blower 32. Specifically, in drying the organic solvent, as described above, the organic solvent rapidly evaporates from the coating liquid, thus the drying apparatus 10 having the plurality of drying chambers 14 arranged in line includes only a few drying chambers 14 with an extremely high gas concentration, and other drying chambers 14 have a low gas concentration. Therefore, the exhaust gases from the drying chambers 14 are joined to the joining duct 30 to dilute the exhaust gas from the drying chamber 14 having the high gas concentration with the exhaust gas from the drying chamber 14 having the low gas concentration. Introducing the diluted exhaust gas into the exhaust blower 32 allows the gas concentration of the exhaust gas introduced into the exhaust blower 32 to be reduced with a simple configuration without providing a damper with an opening control motor or a gas concentration meter in each drying chamber 14 to control the gas concentration as is conventional.

Reduction in the gas concentration of the exhaust gas circulated to the circulation blower 26 provided in the supply system 16 is solved by connecting the exhaust duct 28 having the inlet 28A in the lowest gas concentration area among the plurality of exhaust ducts 28, 29 having the inlets 28A, 29A at the different positions in the drying chamber 14 to the supply duct 24 on the inlet side of the circulation blower 26 and connecting the exhaust duct 29 having the inlet 29A in the high gas concentration area to the joining duct 30. Specifically, for the gas concentration distribution in each drying chamber 14, the gas concentrations differ depending on positions in the drying chamber 14. For example, in the drying chamber 14, the gas concentrations differ between the upstream side and the downstream side of the traveling direction of the web 12 with the coating liquid applied thereon. Thus, selecting the exhaust duct 28 having the inlet 28A in the lowest gas concentration area as the exhaust duct to the circulation blower 26 allows the gas concentration to be reduced simply by mixing a minimum fresh air. The exhaust duct 29 having the inlet 29A in the high gas concentration area connects to the joining duct, but the exhaust gas is diluted with the exhaust gas from other drying chambers 14 in the joining duct 30 as described above, causing no problems.

As a result, the gas concentration of the exhaust gas introduced into the circulation blower 26 and the exhaust blower 32 can be reduced by a simple apparatus configuration, thus reducing apparatus costs and running costs.

Figure 2:
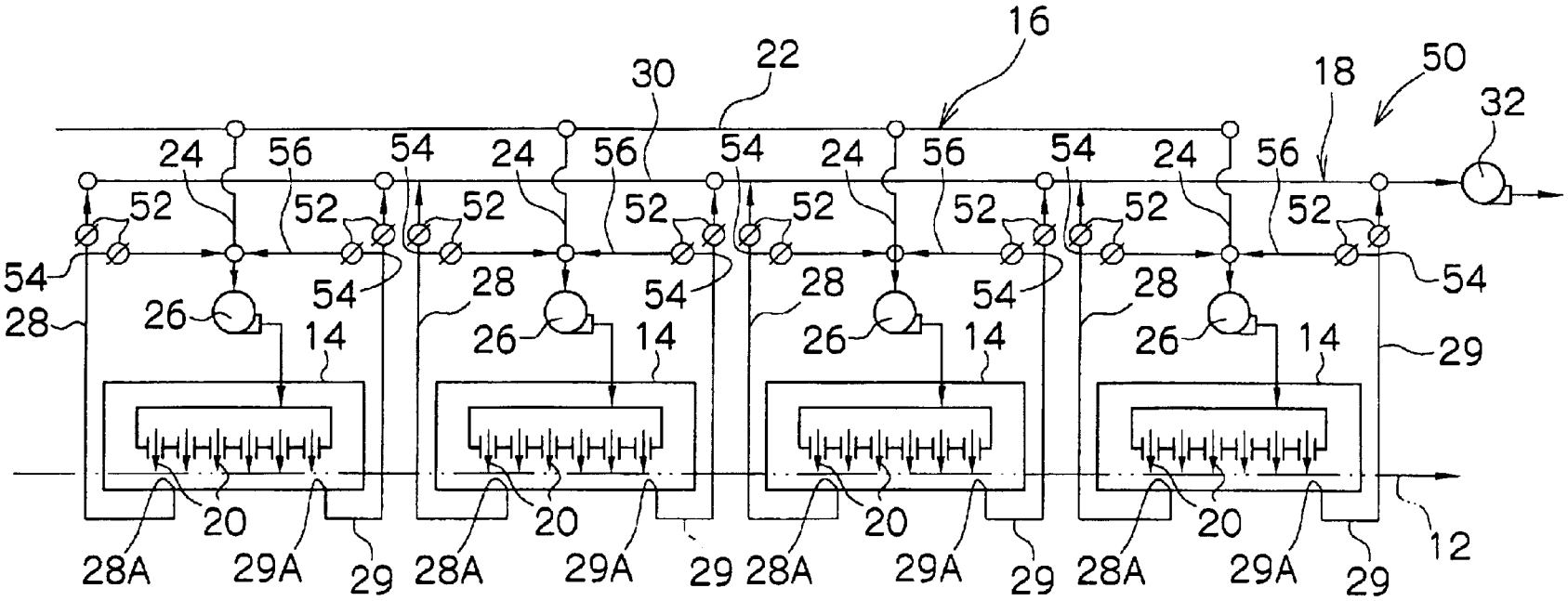
FIG. 2 illustrates a concept of a drying apparatus according to a first embodiment of the present invention.

FIG. 2 illustrates a concept of a drying apparatus 50 according to a second embodiment of the present invention that can optionally switch communication targets of two (at least two) exhaust ducts 28, 29 described in FIG. 1 between a circulation blower 26 and a joining duct 30. The same members as in FIG. 1 are designated by the same reference numerals.

Like the first embodiment, the drying apparatus 50 according to the second embodiment includes four drying chambers 14 arranged in line along a traveling direction of a web 12 with a coating liquid applied thereon, a supply system 16 that supplies a dry air to each drying chamber 14, and an exhaust system 18 that exhausts from the drying chamber 14 an exhaust gas containing an organic solvent evaporated from the coating liquid. The drying chamber 14 and the supply system 16 are the same as in the first embodiment, thus descriptions thereof will be omitted, and the exhaust system 18 will be described below.

The exhaust system 18 includes a joining duct 30 to which the exhaust gases from the drying chambers 14 join, an exhaust blower 32 provided in the joining duct 30, and the two exhaust ducts 28, 29 having inlets 28A, 29A at different positions in the drying chamber 14, and a plurality of dampers 52 that optionally switch the communication targets of the two exhaust ducts 28, 29 between the circulation blower 26 and the joining duct 30.

Specifically, the two exhaust ducts 28, 29 connect to the joining duct 30, and a branch duct 56 that branches off a branch point 54 midway through each of the exhaust ducts 28, 29 connect to an inlet side of the circulation blower 26. Then, the dampers 52 are provided in the branch duct 56, and the exhaust ducts 28, 29 on a side closer to the joining duct 30 than the branch point 54.

According to the second embodiment of the present invention, for example, when gas concentration distribution forms in the drying chamber 14 such that the exhaust duct 28 with the inlet 28A on the upstream side of the web traveling direction has a low gas concentration, and the exhaust duct 29 with the inlet 29A on the downstream side has a high gas concentration, four dampers 52 are opened and closed such that the exhaust gas from the upstream exhaust duct 28 is introduced into the circulation blower 26, and the exhaust gas from the downstream exhaust duct 29 is directly fed to the joining duct 30. Thus, an independent exhaust passage is formed that comprises a duct for circulating the exhaust gas to the circulation blower 26 and a duct for directly feeding the exhaust gas to the joining duct 30. Therefore, as described in the first embodiment, the gas concentration of the exhaust gas introduced into the circulation blower 26 and the exhaust blower 32 can be reduced by a simple apparatus configuration.

Next, when the gas concentration distribution in the drying chamber 14 changes by preparation changes of the coating liquid such that the exhaust duct 28 with the inlet 28A on the upstream side of the web traveling direction has a high gas concentration, and the exhaust duct 29 with the inlet 29A on the downstream side has a low gas concentration, the four dampers 52 are opened and closed such that the exhaust gas from the upstream exhaust duct 28 is directly fed to the joining duct 30, and the exhaust gas from the downstream exhaust duct 29 is introduced into the circulation blower 26. This accommodates changes in preparation of the coating liquid, for example, drying conditions such as a kind of the organic solvent, viscosity of the coating liquid, or a conveying speed of the web 12 to move a dry point and thus change the gas concentration distribution in the drying chamber 14. In this case, it is more preferable to provide a gas concentration meter (not shown) in the two exhaust ducts 28, 29 so that the exhaust duct having the inlet in the lower gas concentration area communicates with the circulation blower based on measurement results.

EXAMPLE

An example will be described in which an intermediate web of a magnetic recording medium with a magnetic coating liquid of composition shown in Table 1 applied on the web is dried by the drying apparatus in FIG. 1. A drying apparatus including an exhaust system that distributes an exhaust gas from one exhaust duct provided in a drying chamber to a circulation blower and a joining duct was used for comparison.

Then, gas concentrations of exhaust gases introduced into the circulation blower were examined in the example and a comparative example.

The coating liquid in Table 1 was applied on a web made of PET (polyethylene terephthalate) of 9 $\mu$m thick and 550 mm wide to form a 2.5 $\mu$m thick dry film at a coating speed of 200 m/min.

TABLE 1

| Composition of coating liquid | Part by weight |
|---|---|
| Ferromagnetic metal fine powder (Composition Fe:Zn:Ni = 92:4:4) (Hc2000 Oe, BET surface area ratio 58 $m^2/g$, acicular ratio 5.0) | 100 |
| Vinyl chloride-vinyl acetate copolymer (degree of polymerization 300) | 12 |
| Polyester polyurethane resin | 3 |
| $\alpha$-alumina (particle size 0.5 $\mu$m) | 1 |
| Carbon black (particle size 0.1 $\mu$m) | 1.5 |
| Butyl stearate | 0.5 |
| Stearic acid | 1.0 |
| Methyl ethyl ketone | 120 |
| Cyclohexane | 150 |
| Toluene | 100 |

Drying conditions in the drying apparatus in both the example and the comparative example were a total amount of exhaust air of 120 $N/m^3$, an amount of supply air for each drying chamber of 30 $N/m^3$ (a total amount of four drying chambers of 120 $N/m^3$), and an amount of circulation air for each drying chamber of 30 $N/m^3$.

In both the example and the comparative example, the concentrations of the exhaust gases exhausted from the drying chambers to the joining duct were 20% for a first drying chamber, 80% for a second drying chamber, 6% for a third drying chamber, and 4% for a fourth drying chamber, seen from an upstream side of a web traveling direction. The gas concentration of the exhaust gas joined to the joining duct was 28%.

Figure 3:
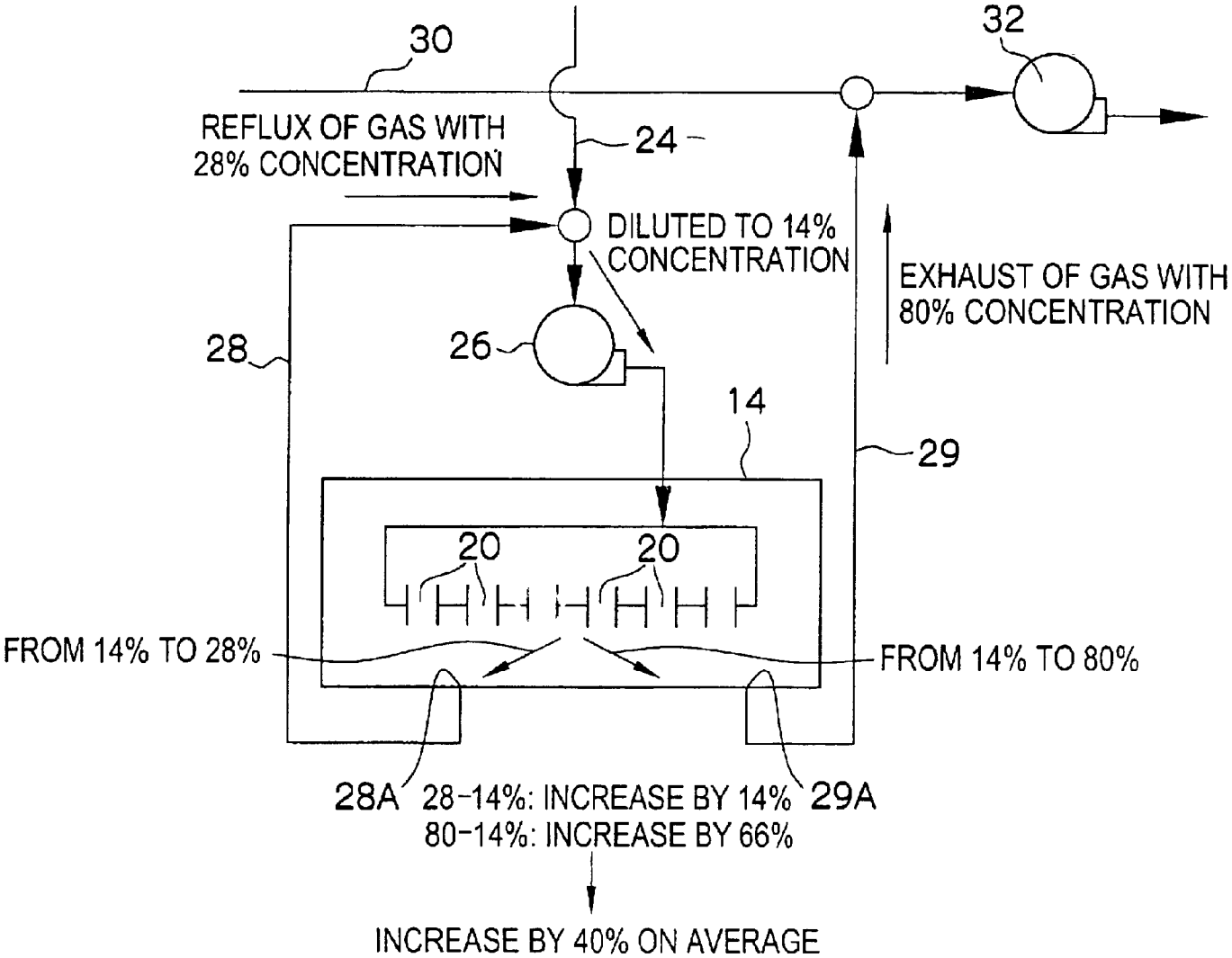
FIG. 3 illustrates an example in which the drying apparatus in FIG. 1 is used to dry an intermediate web of a magnetic recording medium.

FIG. 3 shows the gas concentration of the exhaust gas introduced into the circulation blower 26 noting the second drying chamber having the highest gas concentration when the drying apparatus according to the present invention dries the intermediate web of the magnetic recording medium. As shown in FIG. 3, an exhaust gas with a low gas concentration of 28% from the exhaust duct 28 having the inlet 28A on the upstream side of the web traveling direction and a fresh air are mixed to reduce the concentration to 14%, and then the mixed gas is introduced into the circulation blower 26. In this way, in the example using the drying apparatus of the present invention, even if the drying chamber has the high gas concentration, the gas concentration distribution in the drying chamber is used, and the exhaust duct 28 having the inlet 28A in the low gas concentration area is used as a duct for the exhaust gas circulated to the circulation blower 26, thus causing no danger of explosion in the circulation blower 26. An exhaust gas with an extremely high gas concentration of 80% is fed from the exhaust duct 29 having the inlet 29A on the downstream side of the web traveling direction to the joining duct 30, but the exhaust gas is diluted with the exhaust gas from other drying chambers having the low gas concentration in the joining duct 30, thus causing no problem. This allows the gas concentration in the blower to be an ignition source in view of explosion proofing safety to be kept lower than the lower explosive.

Figure 4:
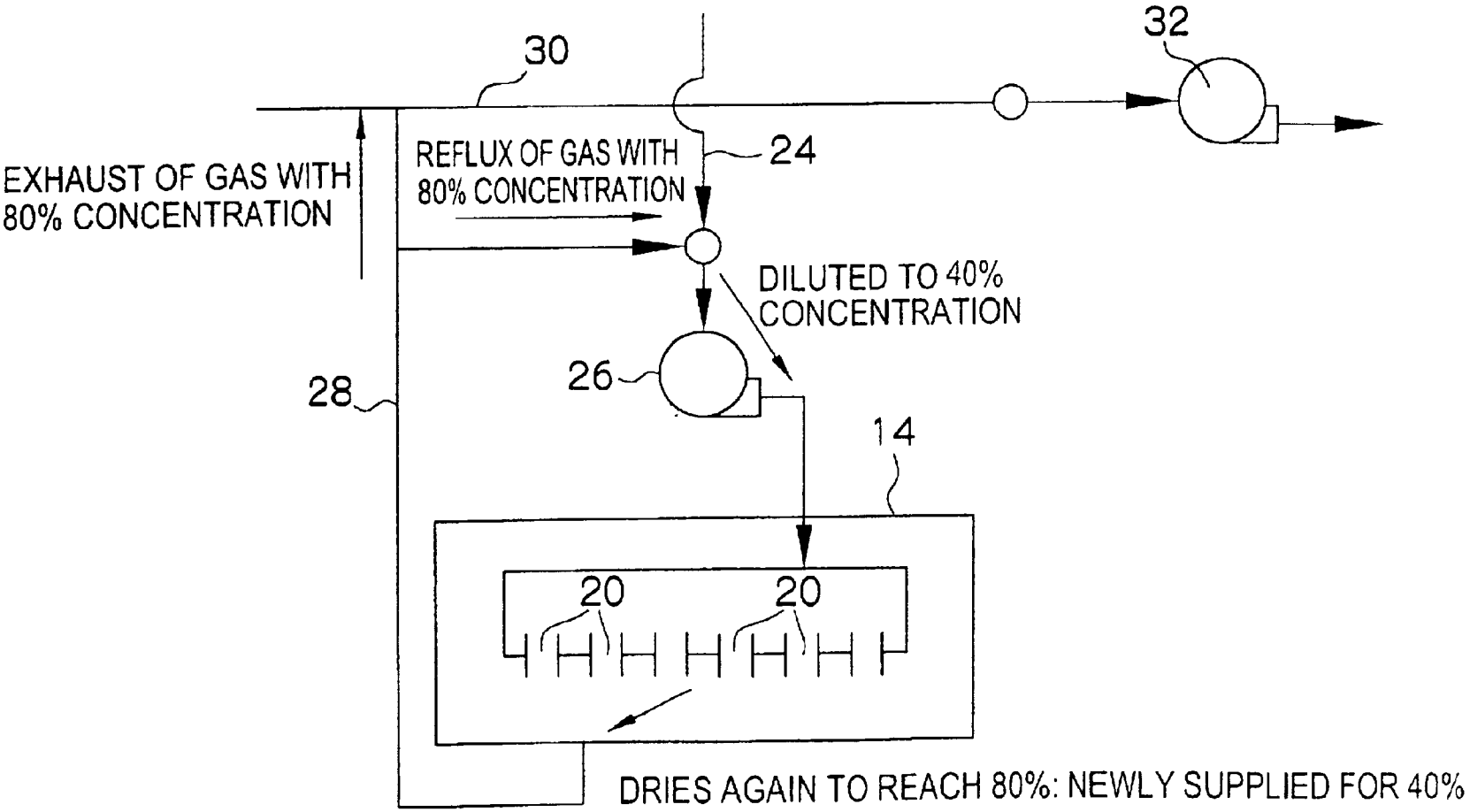
FIG. 4 illustrates a comparative example in which a drying apparatus as a comparative example is used to dry an intermediate web of a magnetic recording medium.

FIG. 4 shows a gas concentration of an exhaust gas introduced into a circulation blower 26 noting a second drying chamber having the highest gas concentration when the drying apparatus of the comparative example dries an intermediate web of a magnetic recording medium. As shown in FIG. 4, an exhaust gas with an 80% gas concentration is distributed to the circulation blower 26 and a joining duct 30 by a single exhaust duct 28. Then, the exhaust gas with the 80% gas concentration is diluted to 40% with a fresh air and then introduced into the circulation blower 26. In the comparative example, the exhaust gas with the high gas concentration of 80% is used as an exhaust gas circulated to the circulation blower 26, thus the high gas concentration of 40% is kept even after the fresh air is mixed. This increases danger of explosion in the circulation blower 26.

As described above, the drying apparatus according to the present invention allows the concentration of the gas introduced into the circulation blower and the exhaust blower to be reduced with the simple equipment configuration, thus simplifying an explosion proof system and significantly reducing equipment costs and running costs.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A drying apparatus, comprising:

a plurality of drying chambers arranged in line through which a web with a coating film applied thereon travels to dry the coating film;

a supply system having in each drying chamber a circulation blower which supplies a dry air that is a mixture of a fresh air and part of exhaust gases circulated from the drying chambers; and an exhaust system which exhausts the exhaust gas from each of the plurality of drying chambers, wherein the exhaust system comprises:

a joining duct to which the exhaust gases from the plurality of drying chambers are joined;

an exhaust blower provided in the joining duct; and a plurality of exhaust ducts provided in each drying chamber and having inlets at different positions in the drying chamber, wherein the plurality of exhaust ducts form an independent exhaust passage comprising a duct for circulating the exhaust gas to the circulation blower, and a duct for directly feeding the exhaust gas to the joining duct.

2. The drying apparatus as defined in claim 1, wherein the plurality of exhaust ducts comprises:

a first exhaust duct having an inlet at a low gas concentration area within the drying chamber; and a second exhaust duct having an inlet at a high gas concentration area within the drying chamber, wherein the exhaust gas of the first exhaust duct is circulated to the circulation blower, and the exhaust gas of the second exhaust duct is directly fed to the joining duct.

3. The drying apparatus as defined in claim 1, wherein the exhaust system further comprises:

a switching device to optionally switch communication targets of the exhaust gas in the plurality of exhaust ducts between the circulation blower and the joining duct; and gas concentration meters provided to the plurality of exhaust ducts to meter gas concentrations, wherein the switching device switches the communication targets of the exhaust gas between the circulation blower and the joining duct in accordance with metering results of the gas concentration meters, so that the exhaust gas in the exhaust duct having the inlet at the lower gas concentration area is circulated to the circulation blower.

4. The drying apparatus as defined in claim 2, wherein the exhaust system further comprises:

a switching device to optionally switch communication targets of the exhaust gas in the plurality of exhaust ducts between the circulation blower and the joining duct; and gas concentration meters provided to the plurality of exhaust ducts to meter gas concentrations, wherein the switching device switches the communication targets of the exhaust gas between the circulation blower and the joining ducts in accordance with metering results of the gas concentration meters, so that the exhaust gas in the exhaust duct having the inlet at the lower gas concentration area is circulated to the circulation blower.

* * * * *